US006595541B2

(12) United States Patent
Kuchler

(10) Patent No.: US 6,595,541 B2
(45) Date of Patent: Jul. 22, 2003

(54) SHORT SKI

(76) Inventor: Marcus Kuchler, Schraudolphstrasse 2a, 80799 Munich (DE)

( * ) Notice: Subject to any disclaimer, the term of this patent is extended or adjusted under 35 U.S.C. 154(b) by 0 days.

(21) Appl. No.: 10/057,965

(22) Filed: Jan. 29, 2002

(65) Prior Publication Data

US 2002/0101058 A1 Aug. 1, 2002

(30) Foreign Application Priority Data

Jan. 30, 2001 (DE) ..... 201 01 556 U

(51) Int. Cl.[7] ..... A63C 5/025

(52) U.S. Cl. ..... 280/601; 280/607; 280/609; 280/11.36; 280/619

(58) Field of Search ..... 280/600, 601, 280/603, 607, 609, 611, 619, 623, 809, 842, 11.3, 11.36, 14.21; 36/115, 116, 119.1, 122, 123, 125

(56) References Cited

U.S. PATENT DOCUMENTS

| | | | | | |
|---|---|---|---|---|---|
| 578,081 | A | * | 3/1897 | Gibbs et al. | 280/11.3 |
| 599,495 | A | * | 2/1898 | Durel et al. | 15/143.1 |
| 1,156,174 | A | * | 10/1915 | Rall | 280/605 |
| 1,529,466 | A | * | 3/1925 | Curfman | 280/600 |
| 1,802,116 | A | * | 4/1931 | Kinsley | 280/7.13 |
| 2,154,019 | A | * | 4/1939 | Westphal | 280/600 |
| 2,439,311 | A | * | 4/1948 | Mayberry | 280/600 |
| 3,082,548 | A | * | 3/1963 | Hartman | 36/116 |
| 3,894,745 | A | * | 7/1975 | Heim et al. | 280/610 |
| 3,931,982 | A | * | 1/1976 | Kubelka | 280/616 |
| 4,004,355 | A | * | 1/1977 | Koblick | 36/122 |
| 4,058,326 | A | * | 11/1977 | Faulin | 280/617 |
| 4,072,317 | A | * | 2/1978 | Pommerening | 280/11.224 |
| 4,188,046 | A | | 2/1980 | Fleckenstein | 280/618 |
| 4,280,715 | A | | 7/1981 | Freelander et al. | 280/623 |
| 4,284,292 | A | * | 8/1981 | Faulin | 280/618 |
| 4,305,603 | A | * | 12/1981 | Muller et al. | 280/607 |
| 4,353,574 | A | * | 10/1982 | Faulin | 280/613 |
| 4,473,235 | A | * | 9/1984 | Burt | 280/11.36 |
| 4,836,571 | A | * | 6/1989 | Corbisiero | 280/600 |
| 5,398,957 | A | * | 3/1995 | Leighton et al. | 280/600 |
| 5,727,797 | A | * | 3/1998 | Bowles | 280/14.21 |
| 5,758,895 | A | * | 6/1998 | Bumgarner | 280/607 |
| 5,787,612 | A | * | 8/1998 | Mahoney et al. | 36/124 |
| 6,113,114 | A | * | 9/2000 | Zemke et al. | 280/14.26 |
| 6,244,615 | B1 | * | 6/2001 | Mendoza et al. | 280/600 |

FOREIGN PATENT DOCUMENTS

| | | |
|---|---|---|
| DE | 34 42 292 | 5/1986 |
| DE | 298 00 470 | 4/1998 |
| EP | 0 385 842 | 9/1990 |
| FR | 2 273 563 | 1/1976 |

OTHER PUBLICATIONS

Catalog of the German mail order firm "Pro Idee", Winter 2002, cover page, back page and p. 19.

EP Search Report Citation Page and Corresponding Foreign Documents Page for Application EP 02 00 1884. Dated May 7, 2002.

* cited by examiner

*Primary Examiner*—Brian L. Johnson
*Assistant Examiner*—Bridget Avery
(74) *Attorney, Agent, or Firm*—Barnes & Thornburg

(57) ABSTRACT

A short ski comprises a base 10 having a pair of side walls 16 on which a pair of arms 11, which hold an ankle belt 12, and a foot belt 13 are mounted. Means are provided for adjusting and fixing the belts 12, 13 so as to accommodate shoes of most different types and sizes and avoid the need for special ski boots.

13 Claims, 1 Drawing Sheet

Fig. 1
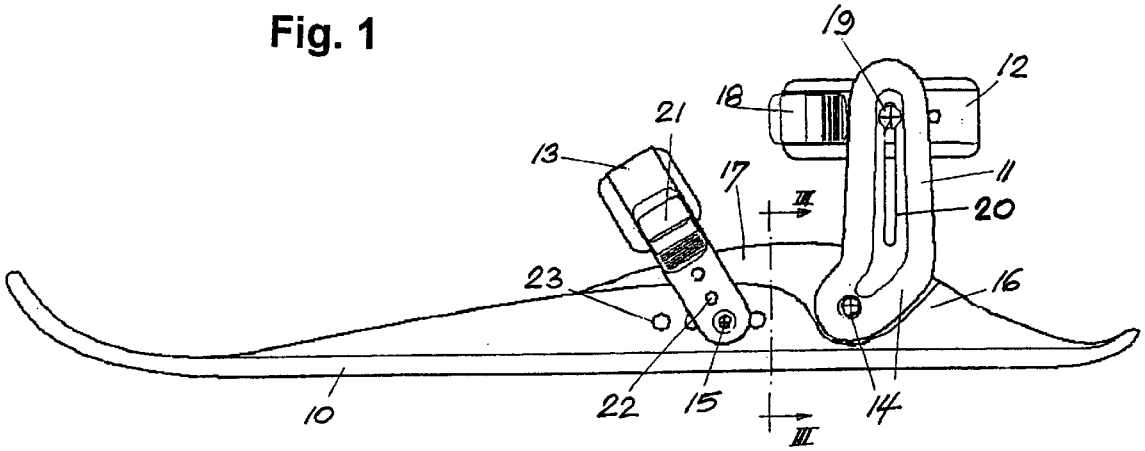
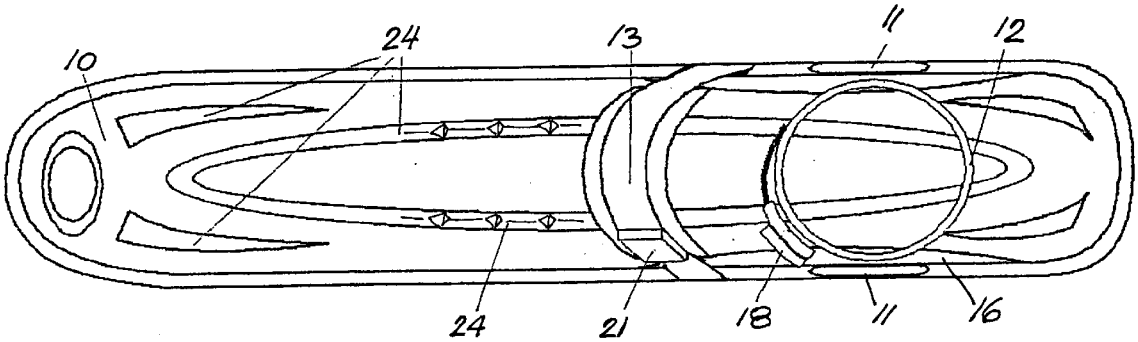
Fig. 2
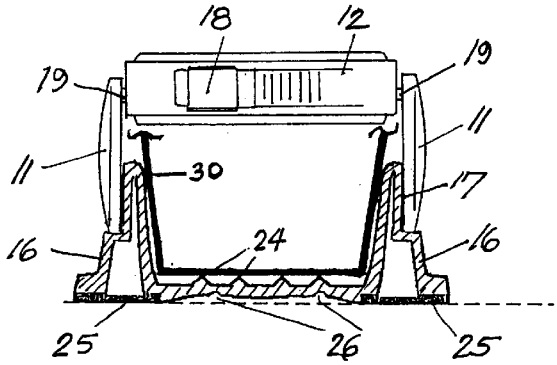
Fig. 3

SHORT SKI

BACKGROUND OF THE INVENTION

Downhill skis are regularly provided with ski-bindings for special ski boots. Ski boots are fixed to the skis at their front and rear ends and, due to their stiffness allow the skier to press on the side edges of the skis by weight transfer thereby controlling the ski.

For snowboards, so-called soft bindings are known. These bindings hold the skier's foot and lower leg and hence can be used with snowboard boots made of a soft material and even allow comfortable walking. The kinematics of the snowboard require the boots to be positioned at an angle to the moving direction. Lateral guiding forces in the bending direction of the ankle are transferred to the snowboard via the heelback and the special structure of a snowboard binding. In use, the skier's calf and forefoot exert pressure on the front and rear edges of the snowboard. Therefore, the principle of a snowboard soft binding is inapplicable to a regular alpine ski.

No presently known ski binding enables controlled downhill skiing with regular climbing boots or sport shoes. This is a particular drawback for mountaineers who have to carry a complete touring ski equipment uphill if they want to ski down, or use so-called "firn gliders" which provide no lateral fixation of the lower leg and therefore allow only little edging and lateral guiding.

SUMMARY OF THE INVENTION

It is an object of the invention to overcome the drawbacks of the prior art and to provide a ski binding for a downhill ski, particularly a short ski, which can be used with shoes of virtually any type and size.

This object is met by a ski having a base and a binding, wherein the binding comprises a support structure mounted on at least one side wall of the base and extending generally upward from the base, and an ankle belt mounted on the support structure for holding the lower leg. This structure permits lateral guiding forces to be transferred to the ski edges, and hence allows effective controlling and braking by transfer of the skier's weight.

In a preferred embodiment, the base comprises a pair of side walls, and the support structure comprises a pair of arms mounted on the respective side walls for pivotal movement about a generally horizontal axis. The arms may be connected at the outer ends to form an integral support structure, It is preferred to dispose the arms in surface abutment with the side walls of the base in the region of their pivot connection. This prevents lateral movements of the ankle and enables an effective transfer of lateral forces from the shoe to the ski. The arms can pivot forward and backward and allow the ankle to bend.

Alternatively, a stiff connection, which is necessary to avoid torsional movements, can be realised by a longer pivot axis.

In accordance with another embodiment of the invention, each side wall has its outer side provided with a recess which is shaped so as to allow the arm to be folded down forward from an upright position but prevent any rearward rotation.

The binding may further comprise a foot belt for holding the shoe down on the ski. The foot belt may be mounted on the side walls for vertical and horizontal adjustment, and adjustment means may be provided, preferably including a plurality of holes in at least one side wall for cooperation with a plurality of holes in the foot belt. At least one of the support structure, the ankle belt and the foot belt may be fixed by screw connections, and at least one of the ankle and foot belts may be adjustable in length by means of a buckle. Further, the ankle belt may be adjustably connected to the support structure. All these features increase the variability concerning size and shape of the shoe to be used with the ski of the present invention.

The running behaviour of the ski may be improved by a profile provided in the upper surface of the base, metal edges formed at the lower side of the base along the longitudinal sides thereof, and guiding grooves formed in middle portion of the lower base surface.

The base and support structure may be produced at low cost by injection moulding. Alternative production methods include blowing, lamination and extrusion. The ankle and foot belts are preferably made of foam rubber or other soft materials and have their fastening portions reinforced by hard plastics elements.

A preferred embodiment will be explained below with reference to the drawing.

BRIEF DESCRIPTION OF THE DRAWING

FIG. 1 is a schematic side view of a complete short ski;

FIG. 2 is a schematic top view of the ski of FIG. 1; and

FIG. 3 is a sectional view taken along the line III—III in FIG. 1.

DETAILED DESCRIPTION OF THE PREFERRED EMBODIMENT

FIG. 1 shows the ski with its base 10 and binding in a side view. The main components of the binding include a support structure consisting of a pair of flat rigid arms 11, an ankle belt 12 mounted on the arms 11, and a foot belt 13. The arms 11 and the foot belt 13 are pivotally mounted on side walls 16 of the base 10 by screw connections 14, 15.

The side walls 16 are reinforced in the region where the arms 11 are hinged to them and comprise recesses 17 on their outer sides which have a depth approximately equal to the thickness of the arms 11.

The recesses 17 are shaped so that the arms 11 provide limited freedom of the skier's lower leg to move forward and backward and can be folded down completely in the forward direction for transport. Folding backward, however, is prevented by the arms 11 abutting against the wider portion of the side walls 16.

The pivotal movement of the arms 11 can be attenuated by friction or by spring elements. Such attenuation may be specifically desirable to improve the behaviour of longer skis.

As will be understood from FIG. 3, the arms 11 are in surface abutment with the side walls 16 in the region of the recesses 17, and are thus supported by the side walls 16 so as to prevent torsional movements.

The generally annular ankle belt 12 can be adjusted in length by means of a toothed belt or buckle 18 as it is common with snowboard bindings and ski boots. The ankle belt 12 is pivotally mounted on the arms 11 by means of screw connections 19 which can be released and displaced along slots 20 formed in the arms 11 in order to adjust the position of the belt 12 to the skier's lower leg.

The foot belt 13 also comprises an adjustable buckle 21. A plurality of holes 22 are provided on at least one end of the foot belt 13 to adjust the belt length. Excessive length of the belt can be folded back or cut off. The position of the foot belt 13 in the longitudinal direction of the base 10 can be varied by joining the belt 13 by means of a screw connection 15 to any one of a number of holes 23 formed in each side wall 16.

The various adjusting elements described above permit the ski binding to be adjusted to shoes of even very different types and sizes. In fact, the short ski of the present invention can be used with virtually all common types of shoes, particularly sport and climbing shoes ranging from size 24 to size 46 (corresponding to shoe lengths of some 16 to 31 cm).

As can be seen in FIG. 2, the upper surface of the base 10 is formed with projections 24 to prevent the shoe from slipping on the base 10. Particularly in the middle portion, where the shoe 30 (FIG. 3) is to be fixed, these projections 24 comprise ribs and teeth facing in different directions.

According to FIG. 1, the base 10 is smoothly bent upwards at its front and rear ends to compress the snow during skiing. The overall length of the ski in this embodiment is approximately 60 cm.

As appears from the sectional view of FIG. 3, the side walls 16 are hollow. This structure is preferable for injection moulding production and provides advantages with respect to design and weight. Areas exposed to stress may be reinforced by inserts of metal or other material placed in the hollow portions.

Metal edges 25 are fixed, such as by rivets or screws or by integration during the injection process, along at least part of the lower flat length of the base 10 to hold the ski even on icy snow, to reduce wear of the running surface and to enable abrupt stops. The metal edges 25 seal the hollow portions of the base 10 at their bottoms thereof to form a closed sliding surface. Wear of the running surface is effectively reduced by arranging the metal edges 25 so that they form the lowermost part of the base, thereby restricting any contact of the ski with hard surfaces, e.g. when crossing asphalt or other high friction material, to the metal edges 25.

The lower surface of the base 10 in its middle portion is formed with grooves 26 to improve the guiding ability of the ski.

The invention has been described with reference to a short ski, where forces arising in use are smaller and thus easier to control with a binding made entirely of plastics. The principle of the ski and binding according to the invention, however, is applicable also to normal length downhill skis, touring skis, trick skis, carving skis and mono skis.

What is claimed is:

1. A ski comprising a base having a pair of integral side walls, and a binding including a support structure comprising a pair of spaced arms each mounted on a respective one of said side walls on opposite sides of the ski such that the pivot is spaced forwardly of the rear end of the ski for pivotal movement about a generally horizontal axis, and an ankle belt mounted on said arms for holding the skier's lower leg, wherein said arms are in surface abutment with said side walls in the region where they are mounted on said side walls to limit lateral movement of the ankle and to transfer lateral guiding forces from the ankle to the ski edges.

2. The ski of claim 1 comprising a spring connected to at least one arm for attenuating pivotal movement of the at least one arm with respect to its respective side wall.

3. The ski of claim 1 comprising a screw connected to at least one arm for adjusting frictional engagement with the at least one arm and its respective side wall.

4. The ski of claim 1 wherein the arms are displaced from the end of the ski to enable an effective transfer of lateral forces from the ankle to the ski.

5. The ski of claim 1, wherein said binding further comprises a foot belt for holding the a shoe down on the ski.

6. The ski of claim 1, wherein said ankle belt is adjustably connected to said support structure.

7. The ski of claim 1, wherein said base has a profiled upper surface.

8. The ski of claim 1, wherein said base has a lower side including metal edges extending along longitudinal sides of the base, and a middle portion provided with longitudinally extending guiding grooves.

9. The ski of claim 1, wherein said base and said support structure are components produced by injection moulding.

10. The ski of claim 5, wherein said foot belt includes a plurality of holes and is mounted on said side walls for vertical and horizontal adjustment, and wherein adjustment means is provided which includes a plurality of holes in at least one of said side walls for cooperation with the holes in said foot belt.

11. The ski of claim 5, wherein at least one of said support structure, said ankle belt and said foot belt is fixed to said base by screw connections.

12. The ski of claim 5, wherein at least one of said ankle belt and foot belt is adjustable in length by means of a buckle.

13. A ski comprising a base having a pair of side walls, and a binding including a support structure comprising a pair of arms each mounted on a respective one of said side walls for pivotal movement about a generally horizontal axis, and an ankle belt mounted on said support structure for holding the skier's lower leg, wherein said arms are in surface abutment with said side walls in the region where they are mounted on said side walls, each of said side walls having an outer side provided with a recess which is shaped so as to allow the respective one of said arms to be folded down forward from an upright position but prevent rearward rotation of said arm.

* * * * *